US008280697B2

(12) United States Patent
Thiel et al.

(10) Patent No.: US 8,280,697 B2
(45) Date of Patent: Oct. 2, 2012

(54) CONCRETE PAVEMENT SYSTEM AND METHOD

(75) Inventors: Patrick A. Thiel, Spring, TX (US); James W. Mack, Houston, TX (US)

(73) Assignee: Cemex, Inc., Houston, TX (US)

( * ) Notice: Subject to any disclaimer, the term of this patent is extended or adjusted under 35 U.S.C. 154(b) by 897 days.

(21) Appl. No.: 12/267,506

(22) Filed: Nov. 7, 2008

(65) Prior Publication Data

US 2009/0129862 A1 May 21, 2009

Related U.S. Application Data

(60) Provisional application No. 60/986,320, filed on Nov. 8, 2007.

(51) Int. Cl.
*G06F 17/50* (2006.01)

(52) U.S. Cl. ..... 703/1; 700/97

(58) Field of Classification Search ..... 703/1
See application file for complete search history.

(56) References Cited

U.S. PATENT DOCUMENTS

| | | | | |
|---|---|---|---|---|
| 3,854,968 | A | 12/1974 | Minnick et al. | |
| 4,121,759 | A | 10/1978 | Merkel et al. | |
| 5,943,234 | A | 8/1999 | Martinez et al. | |
| 6,830,408 | B1 | 12/2004 | Blankenship et al. | |
| 7,386,368 | B2 * | 6/2008 | Andersen et al. | 700/265 |
| 2004/0118322 | A1 | 6/2004 | Sapozhnikov | |
| 2004/0120761 | A1 | 6/2004 | Sapozhnikov | |
| 2006/0287773 | A1 * | 12/2006 | Andersen et al. | 700/265 |
| 2007/0094990 | A1 | 5/2007 | Covarrubias | |

FOREIGN PATENT DOCUMENTS

| | | | |
|---|---|---|---|
| JP | 59084974 | A | 5/1984 |
| JP | 07157761 | A2 | 6/1995 |
| WO | 2007026977 | A1 | 3/2007 |

OTHER PUBLICATIONS

Khanum, Taslima, "Kansas Rigid Pavement Analysis Following New Mechanistic-Empirical Design Guide", Thesis, Department of Civil Engineering, Kansas State University, 2005.*

National Cooperative Highway Research Program, "Guide for Mechanistic-Empirical Design of New and Rehabilitated Pavement Structures", Final Report, Appendix C, Mar. 2004.*

National Cooperative Highway Research Program, "Guide for Mechanistic-Empirical Design of New and Rehabilitated Pavement Structures", Final Report, Part 2. Design Inputs, Chapter 5, Evaluation of Existing Pavements for Rehabilitation, Mar. 2004.*

Blaine R. Copenheaver, International Search Report for Corresponding International Patent Application No. PCT/US2008/082921, United States Patent Office.

Blaine R. Copenheaver, Written Opinion for Corresponding International Patent Application No. PCT/US2008/082921, United States Patent Office.

(Continued)

*Primary Examiner* — Mary C Jacob
(74) *Attorney, Agent, or Firm* — Locke Lord LLP

(57) ABSTRACT

A method of optimizing a concrete pavement design including estimating conditions of the pavement, determining properties of the pavement and developing a concrete pavement system. The method may further include selecting a thickness for the system, predicting performance of the system, determining costs of the system, and optimizing the pavement design based on one or more considerations. The method may include iterating one or more considerations. An optimized pavement system having predetermined design parameters.

18 Claims, 6 Drawing Sheets

OTHER PUBLICATIONS

National Cooperative Highway Research Program, Transportation Research Board, and National Research Council. "Guide for Mechanistic-Empirical Design of New and Rehabilitated Pavement Structures." Final Report, Appendix D, http://www.trb.org/mepdg/appendix_D_Examples%20Users%20Guide.pdf, Mar. 2004.

Emery, J.A. et al., The Design of Concrete Block Aircraft Pavements, Concrete Block Paving; Proceedings of the third international conference; Rome, 17, May 9, 1988, pp. 178-192, Treviso, Pavitalia.

Webb, D.L. et al., Soils in Pavement Engineering, Proceedings of Symposium on precast concrete paving block, Johannesburg, Nov. 14, 1979, Paper 5 (separately paginated), Concrete Society of Southern Africa.

Van Leeuwen, H., Land Reclamation—Minimising the Difficulties, Port Construction International, vol. 1, No. 1, Summer 1983, pp. 14-15.

Watanabe, N. et al., Behavior of Interlocking Block Pavement Under Heavy Axle Load, Review of the 40th general meeting, technical session, Tokyo, May 1986, Cement Association of Japan, pp. 434-437.

Kellersmann, G.H. et al., Site Investigations of Amsterdam Concrete Block Pavements, Proceedings of the third international conference; Rome, 17, May 9, 1988, pp. 121-129, Treviso, Pavitalia.

Bushman, William H., et al., Stabilization Techniques for Unpaved Roads, Transportation research record, No. 1936, published 2005, p. 28-33, United States.

De Rezende Lilian, Ribeiro, et al., Use of Locally Available Soils on Subbase and Base Layers of Flexible Pavements, Transportation research record, International Conference on Low-Volume Roads, 8, No. 1819, pp. 110-121, 2003, Reno, Nevada, United States.

Brabston, William N. et al., COE Design of Cement Stabilized Base Courses for Airfield Pavements, Concrete International, p. 19, 1991, George F. Leyh, Detroit, MI, United States.

* cited by examiner

CONCRETE PAVEMENT SYSTEM AND METHOD

CROSS REFERENCE TO RELATED APPLICATIONS

This application claims the benefit of and priority to U.S. Provisional application Ser. No. 60/986,320, filed on Nov. 8, 2007, the entire contents of which are incorporated herein by reference for all purposes.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

1. Field of the Invention

The inventions disclosed and taught herein relate generally to concrete pavements; and more specifically relate to the efficient use of Portland cement concrete ("PCC") in pavement design and construction.

2. Description of the Related Art

Soil is the unconsolidated, in-situ (in place) material upon which all pavements are constructed. The engineering, chemical and mineralogical properties of a particular soil can vary based on its geological history, such as its parent material (rock type such as limestone, sea shells, granite, etc.), how it was deposited (glacial, water-lain, wind blown, residual), grain size distribution (boulders to microscopic), etc. The engineering properties of a soil affecting pavement performance include strength, swell potential, soil permeability, moisture content, erodibility, and mineralogy. These properties and others will vary even within the same soil type or formation. Commonly, a pavement project, such as a roadway, will cross over multiple soil formations and, as such, the properties of the soils can vary significantly over the breadth of the project. The performance of a pavement may depend on the soil properties on which it sits and how the designer takes the specific soil properties into account. For example, to reduce the soil swell potential, stabilizers such as cement, fly ash, and lime may be mixed with the soil. The effect of the soil stabilization can be dependant on the soil mineralogy, often times limiting the choice of stabilizer, or requiring more of it. Additionally, soluble sulfates may exist in portions of the soil and when mixed with a calcium based stabilizer, may experience significant heave, which may cause damage to the pavement. As well, organic particles within the soil may require increased levels of stabilizers. All of the above, along with other factors, may be considered when designing and building pavements.

Historically, on the one hand, asphalt, or flexible, pavements tend to have a lower initial installed cost as compared to concrete, or rigid, pavements. On the other hand, concrete pavements tend to have a longer life cycle, lower maintenance costs and lower costs of ownership over periods of time. The conceptual design for asphalt pavements typically involves a life expectancy of approximately 7 years before scheduled maintenance. Scheduled maintenance may include milling the asphalt surface and placing a 2" overlay of asphalt thereon. This maintenance is designed to last another 7 years before repeating the mill and overlay steps. This concept has become known as "staged construction." Recently, the asphalt industry introduced a higher performance material referred to as "perpetual asphalt." Perpetual asphalt typically costs about the same as a concrete pavement. While perpetual asphalt is touted to outlast and outperform densely graded asphalt, it may not last as long or enjoy the low maintenance costs associated with concrete pavements.

Concrete pavements have been designed to perform with little or no maintenance for 30 or more years. There are three basic types of concrete roadways. Jointed Plain Concrete Pavement (JPCP) may have transverse joints spaced less than about 17 feet (5 m) apart and may have no reinforcing steel in the roadway. JPCP construction may, however, contain steel dowel bars across transverse joints and steel tie bars across longitudinal joints.

Jointed Reinforced Concrete Pavement (JRCP) has transverse joints spaced about 30 to 40 feet (9 to 12 m) apart and contains steel reinforcement in the roadway. The steel reinforcement is designed to hold together any transverse cracks that develop. Dowel bars and tie bars are also used at transverse and longitudinal joints.

Continuously Reinforced Concrete Pavement (CRCP) has no regularly spaced transverse joints and contains more steel reinforcement than JRCP construction. The high steel content affects the development of transverse cracks and holds these transverse cracks together.

It is estimated that about at least 70 percent of the states in the United States build JPCP roadways, about 20 percent of the states build JRCP roadways, and about six or seven state highway agencies build CRCP roadways. Texas, for example, requires CRCP on streets or roadways with speed limits greater than 45 mph. CRCP roadways typically cost about 20% more than JPCP roadways.

A number of standard design guidelines for pavements have been and are being developed for pavement design and analysis. For example, the most widely used pavement design guidelines for the design of concrete roadways is the *Guide for Design of Pavement Structures* published in, for example, 1986 and 1993 by the American Association of State Highway and Transportation Officials (AASHTO '86; AASHTO '93). Another procedure for the design of concrete roadways includes the use of the Mechanistic-Empirical Pavement Design Guide and software (MEPDG), sponsored by the AASHTO Joint Task Force on Pavements, and which is currently being developed and tested by a number of individuals and entities throughout the United States for use in design and forensic evaluation of pavements. The contents of each of these pavement design guidelines are incorporated herein by reference for all purposes. The AASHTO procedures require a prediction of the number of 18,000 $lb_f$ Equivalent Single Axle Load ("ESAL") that the pavement will experience over its design life. It is typical to use an ESAL of 20 million or more for a Portland cement concrete roadway. Other pavements design guidelines may also be employed as required by a particular application. For example, a set of guidelines published by the American Concrete Institute may be used for the design of a parking lot, driveway, or elevated concrete structure.

The design thickness of a concrete pavement, such as a roadway or parking lot, may be selected to allow long-term performance under a forecasted traffic volume with a given soil (substrate) condition. For example, when CRCP pavement is specified in Texas, the accepted road design historically requires a 12-13 inch uniform thickness of CRCP from the beginning to the end of the proposed road (lane mile) and across the roadway width. In contrast, Texas does not require this thickness (volume and uniformity) for asphalt pavements.

Furthermore, it is well known that substrate plasticity issues and/or sulfate issues can promote heaving, which may negatively impact the integrity of the pavement life cycle. In addition, variations in the water table can negatively affect concrete pavement design and performance. Requiring a uniform pavement thickness (e.g., 12"-13") and continuous rebar placement throughout the pavement is a low-tech method of addressing varying conditions of the substrate.

Indeed, under the AASHTO design procedure, the modulus of the subgrade/subbase reaction (i.e., K-value) has a minimum effect on the designed roadway thickness. That is, a worst-case thickness design, such as may be required in some states, does not match the actual substrate conditions to the roadway design. In lieu of this, most designs establish a uniform thickness to compensate for variability in the substrate. This means that most concrete pavement designs are over-engineered and, therefore, overly expensive since the design is for the worst section of pavement and does not take into account the varying substrate conditions. This worst case design methodology typically carries a high initial installation cost (especially when compared to densely graded asphalt as an alternate design). With limited budgets, agencies, such as state departments of transportation, contractors, and others tend to choose the lower initial cost of an asphalt design, without respect to higher maintenance or life cycle costs.

The inventions disclosed and taught herein are directed to an improved concrete pavement system and method of designing an improved concrete pavement system.

BRIEF SUMMARY OF THE INVENTION

From one point of view, the inventions disclosed herein may be summarized as a method of optimizing a concrete pavement design, including estimating one or more attributes, such as a traffic level of environmental condition, affecting the pavement. The method may include determining attributes at one or more locations along the substrate and may include determining one or more characteristic properties of the section subgrade or substrate. The method may include developing one or more concrete systems and attributes thereof. The attributes may include one or more thicknesses, performance, costs, or other characteristics. The method may include determining an optimum thickness for the system at one or more desired locations. For example, the thickness of the system at a particular location may be determined as a function of one or more other attributes, such as strength or cost. Also, the method may include optimizing the pavement design based on one or more factors, which may include developing more than one concrete system and/or iterations thereof. The disclosure further contemplates enhancing the K-values of the substrate at one or more locations.

From another point of view, the inventions disclosed herein may be summarized as a pavement system, having predetermined design parameters. The pavement system may include a substrate underlying the roadway, and one or more layers, such as subgrade, base, or pavement layers. One or more layers may be optimized, such as by having a thickness or other characteristic that varies by location. A characteristic may vary based on, or be proportional to, on or more design parameters. The design parameters of the pavement may, for example, include one or more of those contemplated by the AASHTO or MEPDG design procedures.

DETAILED DESCRIPTION

Figure 1:
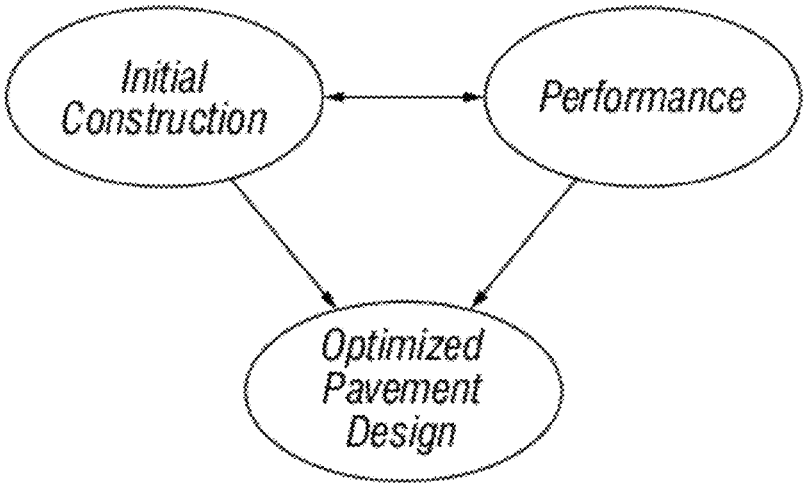
FIG. 1 shows one of many embodiments utilizing certain aspects of the present invention.

The Figures described above and the written description of specific structures, methods, and functions below are not presented to limit the scope of what Applicants have invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location, and from time to time. While a developer's efforts might be complex and time-consuming in an absolute sense, such efforts would be, nevertheless, a routine undertaking for those of skill in this art having benefit of this disclosure. It must be understood that the inventions disclosed and taught herein are susceptible to numerous and various modifications and alternative forms. Lastly, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims.

Computer programs for use with or by the embodiments disclosed herein may be written in an object-oriented programming language, conventional procedural programming language, or lower-level code, such as assembly language and/or microcode. The program may be executed entirely on a single processor and/or across multiple processors, as a stand-alone software package or as part of another software package.

In general, Applicants have created an improved concrete pavement system and method of designing an improved concrete pavement system, in which the pavement system design is matched to specific design parameters such as the substrate underlying portions of the pavement.

One aspect of the invention disclosed herein is a pavement system that is designed by conducting an assessment of the substrate underlying the planned roadway, and determining the level of plasticity and/or sulfates, water table, and consistency of the soils. In areas where soils are highly plastic or rich in sulfates, the soil may be modified, such as through an application of lime, cement, and/or fly ash to produce a soil with a reduced plasticity or sulfate level to provide a substrate with a higher K-Value, (compressive strength, psi/in.). Applicants have found that substrates with higher K-Values permit a reduction in concrete pavement thickness while continuing to deliver the required performance over a forecasted time period. In areas where the soil is rich in limestone and low in sulfate or plasticity, a minimum amount of soil stabilization/modification may be necessary or desired in accordance with a particular application.

Another aspect of the present invention involves analyzing the substrate conditions of the proposed pavement and determining prevailing or performance limiting issues, such as high water tables, sulfates and/or plasticity of the soils.

The inventions disclosed and taught herein allow, for example, the design of a PCC CRCP roadway of less than 12 inches in thickness in locations where the soil conditions are excellent (e.g., over limestone) to meet the projected ESALs (traffic volume) for the design time period. For areas where the soil has performance limiting issues, the invention contemplates utilizing soil stabilizing cement or other materials to increase the K-Value of the substrate, thereby providing a compressive strength platform upon which to build the roadway. Applicants have observed an inverse correlation between substrate K-Values and the pavement thickness (inches) needed to maintain performance over a given time period for a projected ESALs. That is, as the substrate K-Value increases, the thickness of the roadway design may decrease.

The invention also contemplates designing a pavement of varying thickness based upon substrate properties. For example, pavement thickness may be increased in the area(s) where soil conditions may require additional thickness to achieve the design parameters. In other words, the invention contemplates selecting between modifying the substrate properties to utilize a reduced thickness pavement and increasing pavement thickness to account for substrate properties.

The invention contemplates designing the pavement from the substrate up through the pavement material and determining the pavement thickness based upon the properties of the substrate (e.g., condition of the soil and water tables). The invention allows for a custom designed and installed concrete pavement, rather than simply requiring a pre-specified pavement design for the entire length/width of the pavement, which is an over-engineered and overly expensive design approach.

The invention may be practiced in a "greenfield" situation, that is, where no pavement exists over the substrate, or in a "white-topping" situation, such as a maintenance alternative after a service life of an existing pavement.

The invention contemplates a systematic approach to pavement design that takes into account the specifics for a particular application or project and implements the best practices of concrete pavement design to develop a unique and optimal result. Pavement design needs may vary by customer and/or by project, and the current invention contemplates balancing factors such as the predetermined design parameters, costs, and performance to optimize a particular design.

Turning now to a specific example of how the present invention can be used to optimize a concrete pavement design, FIG. 1 shows one of many embodiments utilizing certain aspects of the present invention. The method may include balancing considerations associated with initial construction with considerations associated with the performance of a particular concrete pavement design to develop one or more optimized pavement designs. Considerations associated with initial construction may include, for example, the level of traffic, environmental conditions, or subgrade properties for a pavement section. As other examples, initial construction considerations may include pavement type, thicknesses, materials, material properties, costs, or other considerations required by a particular application. Considerations associated with performance may include, for example, maintenance cycles, rehabilitation cycles, traffic patterns, costs, or other considerations required by a particular application. The considerations may be analyzed separately, together, or in combination and may change between applications or within an application, to develop, for example, one or more concrete systems. The method may further include iterating the one or more concrete systems or portions thereof, such as thicknesses or other features, to develop one or more optimized pavement designs.

In at least one exemplary embodiment, an optimized design may be found by iterating concrete thickness and/or other features, and balancing initial costs, life cycle costs and performance. The costs may include, for example, material costs, construction costs, approval costs, or other costs. Performance may be affected by, for example, pavement design, materials, and the construction associated therewith. Performance may be further affected by estimations, predictions, distress types and the extent and severity thereof, cost limitations, substrates or, as another example, minimum standards, such as those set forth by state transportation departments (DOTs), other government entities, or ASTM International, for example.

Figure 2:
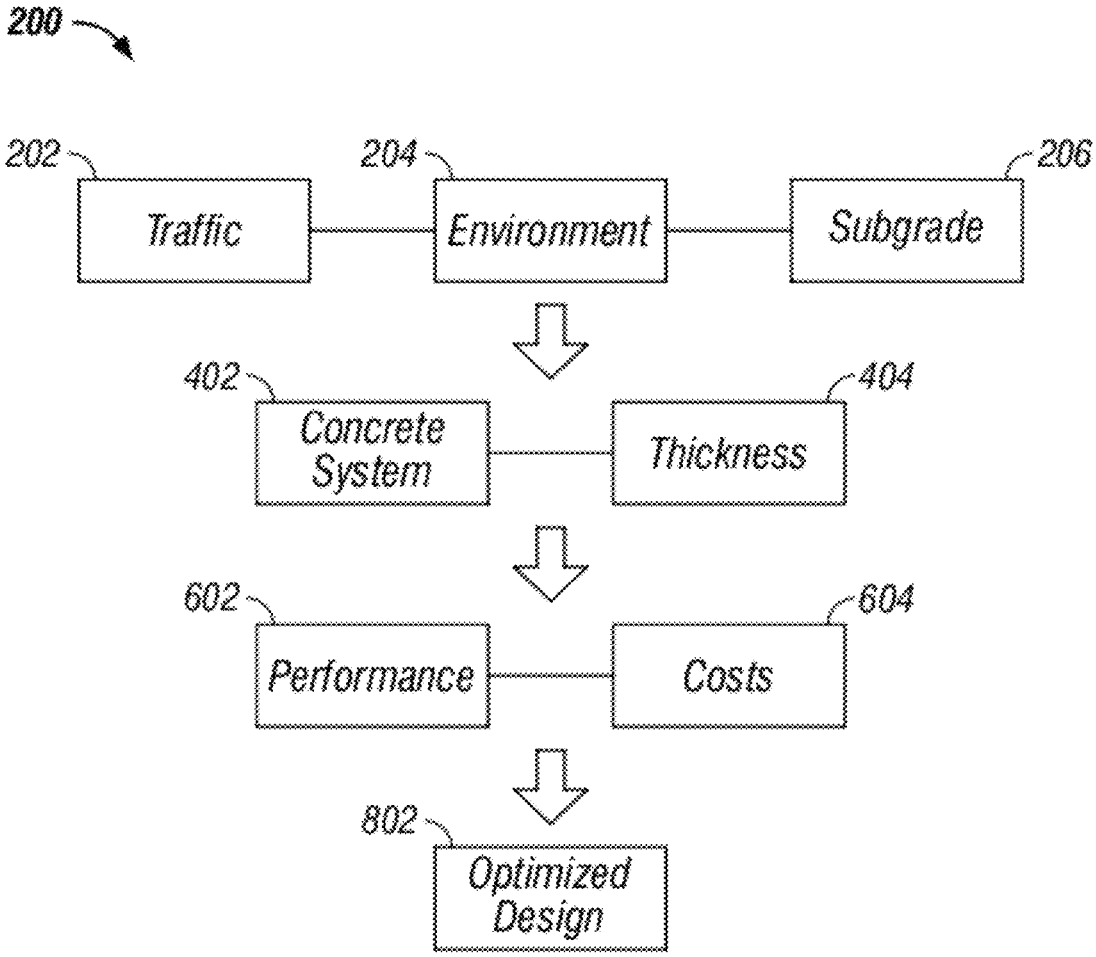
FIG. 2 is a flow chart showing one of many embodiments utilizing certain aspects of the present invention.

FIG. 2 is a flow chart showing one of many embodiments of the present invention. The method 200 may include a series of steps, which may occur in any order required by a particular application. Each step may include considering one or more factors for a particular application. Some factors may be considered singularly, while others may be considered collectively or in combination, in whole or in part. Factors may be considered over any period of time required by a particular application, which may be simultaneously or otherwise. In the exemplary embodiment of FIG. 2, each block represents a number of steps associated with a factor that may be required by a particular application. Each factor may be the same, may change, or may be absent from one application to the next, as will be appreciated by one of ordinary skill in the art.

Each row of steps represents a group of steps that may be related, such as steps that may be taken simultaneously, but need not be. Each step, or group of steps, may comprise a portion of an exemplary systematic approach to optimizing a particular concrete pavement design. Each step may include considering one or more factors associated with particular subject matter required by a particular application to which the method is being applied. For example, each step may include manipulating values or other data, which may include gathering, producing, estimating, analyzing, guessing, determining, approximating, developing, selecting, predicting, optimizing, processing, computing and/or otherwise acting with reference to data related to a particular pavement, or section thereof. Some data may be known, while other data may be unknown. Some data may be constant, while other data may vary. The factors represented in FIG. 2 are for exemplary purposes only, but may generally be common factors encountered during concrete pavement design, as will be understood by one of ordinary skill in the art. The term pavement is used broadly herein and may include an entire pavement, concrete or otherwise, or a portion or section thereof.

The exemplary embodiment of FIG. 2 will now be described in more detail. In this particular embodiment, which is but one of many, a first phase of method 200 may include steps 202, 204, and 206, which may include considering factors relating to the traffic, environment, and subgrade, respectively, required by a particular pavement. For example, step 202 may include manipulating traffic data to understand how traffic may affect the pavement, such as estimating a level of traffic for a particular pavement. Step 202 may include, for example, gathering data, such as from a state Department of Transportation (DOT), or other entities. As another example, step 202 may include estimating ESALs for a particular pavement. Step 204 may include manipulating environment data for a particular pavement to understand how the environment may affect the pavement. For example, step 204 may include estimating one or more environmental conditions affecting the pavement, such as temperature, precipitation, moisture, humidity, altitude, or other conditions. In at least one embodiment, the MEPDG, or other guidelines, may be used to estimate one or more of these factors. Step 206 may include determining one or more characteristic properties of the pavement subgrade to understand the composition of the pavement. For example, step 206 may include testing or gathering data related to one or more properties of the soil on top of which the pavement is, or will be, disposed. For example, properties may include density, hardness, composition, or other properties.

A second phase of method 200 may include steps 402 and 404, which may include considering factors relating to developing a concrete system and selecting one or more thicknesses, respectively, for a particular pavement. For example, step 402 may include developing a concrete system, which may have one or more stabilizer mixes therein. Step 404 may include selecting a thickness for the concrete system, which may include selecting one or more thicknesses of one or more layers of a concrete system for the pavement. Steps 402 and 404 may preferably be related and may take place simultaneously, but need not. A concrete system, as will be further described below, may include one or more layers, each layer having a composition, which may be the same or different from any other layer. Similarly, each layer may have a thickness, which may be the same or different from any other layer. The composition or thickness of a particular layer may be fixed, or may be variable, as required by a particular application. The choices involved in steps 402 and 404 may be many, but in any event should include results appropriate for the data manipulated in steps 202, 204 and 206, as will be understood by one of ordinary skill in the art. Steps 402 and 404 may preferably include developing a plurality of concrete systems adequate for a particular pavement.

A third phase of method 200 may include steps 602 and 604, which may include considering factors relating to the performance and costs, respectively, of the one or more concrete systems associated with the results of steps 402 and 404. For example, step 602 may include predicting the performance of one or more concrete systems for the pavement to estimate how the pavement will change over time. Step 602 may include, for example, estimating the life-cycle of the pavement, such as when repairs may be necessary, and the types and extent of the repairs. As another example, step 602 may include predicting distresses of the pavement, which may include punchouts, roughness, cracks, faulting, spalling, scaling, settlement—to name a few—or other distresses as will be understood by one of ordinary skill in the art. In at least one embodiment of method 200, step 602 may include inputting data resulting from, for example, the first and second phases of method 200 into a computer software program, such as the MEPDG, or another set of guidelines, wherein the predicted performance of the pavement will be the output of the guidelines. Step 604 may include, for example, determining one or more costs associated with the one or more concrete systems resulting from steps 402 and 404 to estimate the magnitude and timing of pavement costs. For example, step 604 may include estimating the initial costs of constructing the one or more concrete systems. As another example, step 604 may include predicting when repairs or rehabilitation construction may be required and how much the repairs may cost. Step 604 may include many considerations as will be understood by one of ordinary skill in the art. As examples, step 604 may include steps such as estimating costs for materials, labor, traffic control, or estimating interest rates, inflation, or other factors—to name a few—required by a particular application.

A fourth phase of method 200 may include step 802, which may include considering data from one or more of the steps or phases described above, in whole or in part, simultaneously or otherwise, to optimize the design for the pavement. For example, step 802 may include optimizing the pavement design by selecting a concrete system based on the performance and costs of the system. For example, one or more characteristics of the systems, thicknesses and associated features from steps 402 and 403 may compared to one another, as may be the associated performances and costs determined in steps 602 and 604. Optimizing the pavement design in step 802 may include iterating the thicknesses and other features or data involved in one or more of the previous steps of method 200. Step 802 may further include balancing initial costs, life cycle costs and performance to select the optimal pavement design as required by the particular pavement. One of ordinary skill in the art will understand that method 200 may vary as required by a particular application, which may include subjective factors and related decisions. The factors may include any factor required by a particular application or customer, and each factor may be fixed, variable or, as other examples, may change from time to time, project to project, or between customers.

Figure 3:
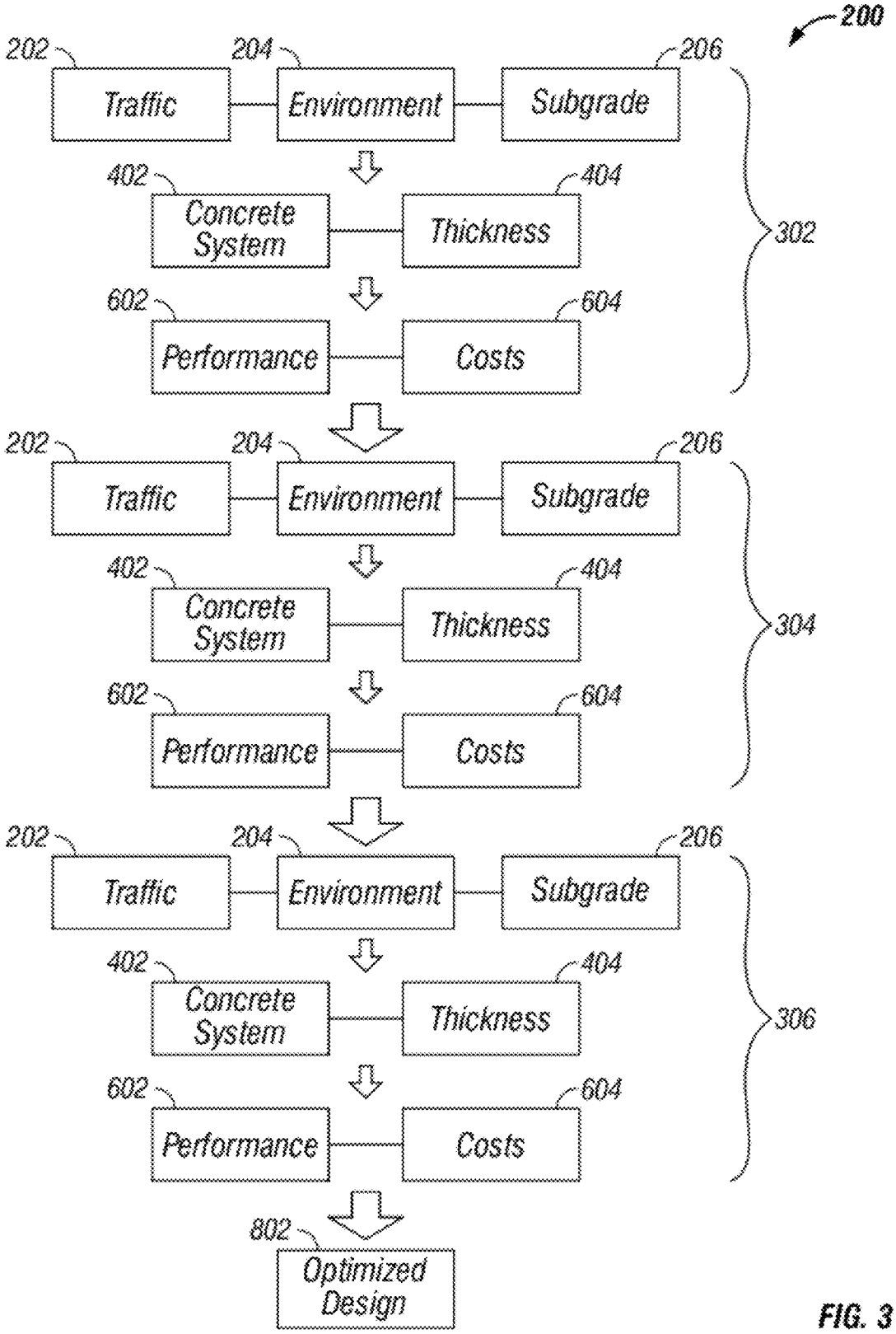
FIG. 3 is a flow chart showing one of many embodiments including iterations and utilizing certain aspects of the present invention.

FIG. 3 is a flow chart showing one of many embodiments including iterations and utilizing certain aspects of the present invention. Method 200 may include a plurality of iterations, such as iterations 302, 304 and 306, for optimizing a pavement design required by a particular application. While FIG. 3 shows three iterations, it should be understood that method 200 may include any number of iterations required by a particular application. Each iteration 302, 304, 306 may include any number of steps, such as one or more of those steps described above with respect to FIG. 2, for manipulating data in accordance with a particular application. For exemplary purposes only, the data resulting from each iteration 302, 304, 306 will be referred to herein as designs X, Y and Z, respectively. In at least one embodiment, for example, iteration 302 may result in performance and cost estimations for a first possible pavement design X, wherein each step of iteration 302 may include manipulating data related to a first set of inputs required by a particular pavement. Similarly, iteration 304 may result in performance and cost estimations for a second possible pavement design Y, wherein each step of iteration 304 may include manipulating data related to a second set of inputs required by the pavement. Iteration 306 may result in performance and cost estimations for a third possible pavement design Z, wherein each step of iteration 306 may include manipulating data related to a third set of inputs required by the pavement. Method 200 may further include optimizing the pavement design by creating a design based on the comparison of one or more characteristics of each of designs X, Y and Z. For example, method 200 may include creating an optimized pavement design based on the subjectively desirable factors of each of designs X, Y and Z, singularly or in combination. In at least one exemplary embodiment, method 200 may include creating the optimized design based on the best balance of overall costs and overall performance estimated for a particular set of data as subjectively decided by a particular customer for a particular application. One of ordinary skill in the art will understand that method 200 may include any number of steps and any number of iterations required by a particular application. One of ordinary skill will also understand that any factor or data contemplated in a particular step may be manipulated in any fashion and as many times as required by a particular application.

Figure 4:
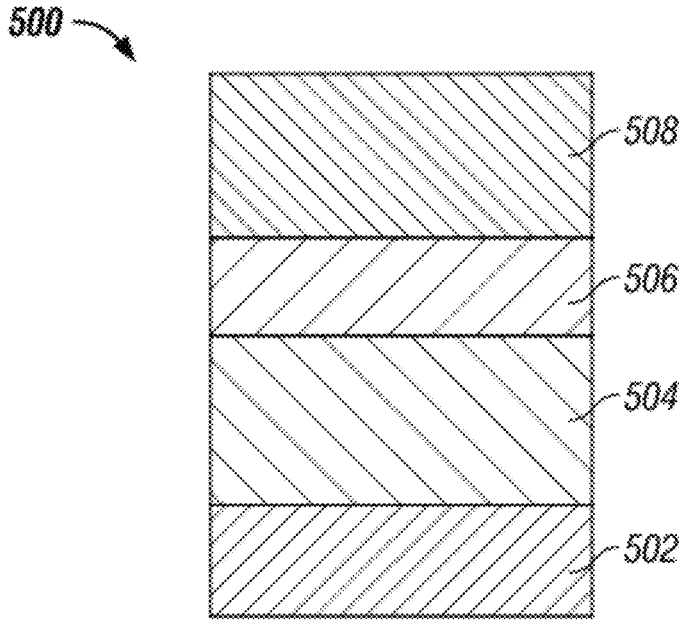
FIG. 4 shows one of many embodiments of an optimized concrete pavement system utilizing certain aspects of the present invention.

FIG. 4 shows one of many embodiments of an optimized concrete pavement system utilizing certain aspects of the present invention. The optimized concrete pavement system, or design 500, may include one or more layers as required by a particular application. For example, the design 500 may include a subgrade layer 502, a subbase layer 504, a base layer 506, and a concrete pavement layer 508. One or more layers, such as, for example, subgrade layer 502, may include a stabilizer for improving the structural characteristics of the layer. For example, a stabilizer may increase a layer's ability to provide long-term support. A stabilized layer may include any stabilizer required by a particular application, separately or in combination. As examples, a stabilizer may include 3% Cement Type I/II and 3% Fly Ash Type C, 4% Cement Type I/II and 4% Fly Ash Type C, 6% Cement TY I/II, 6% Lime, or any combination thereof. One or more of the layers of design 500 may be optimized using the teachings of this disclosure. For example, the thickness of layer 508 may be iterated as described above to determine the optimal thickness for a particular application. The optimal thickness may include, for example, a thickness determined by balancing the performance and costs associated with any number of thicknesses and selecting the thickness that best satisfies the requirements of a particular application or customer.

Figure 5:
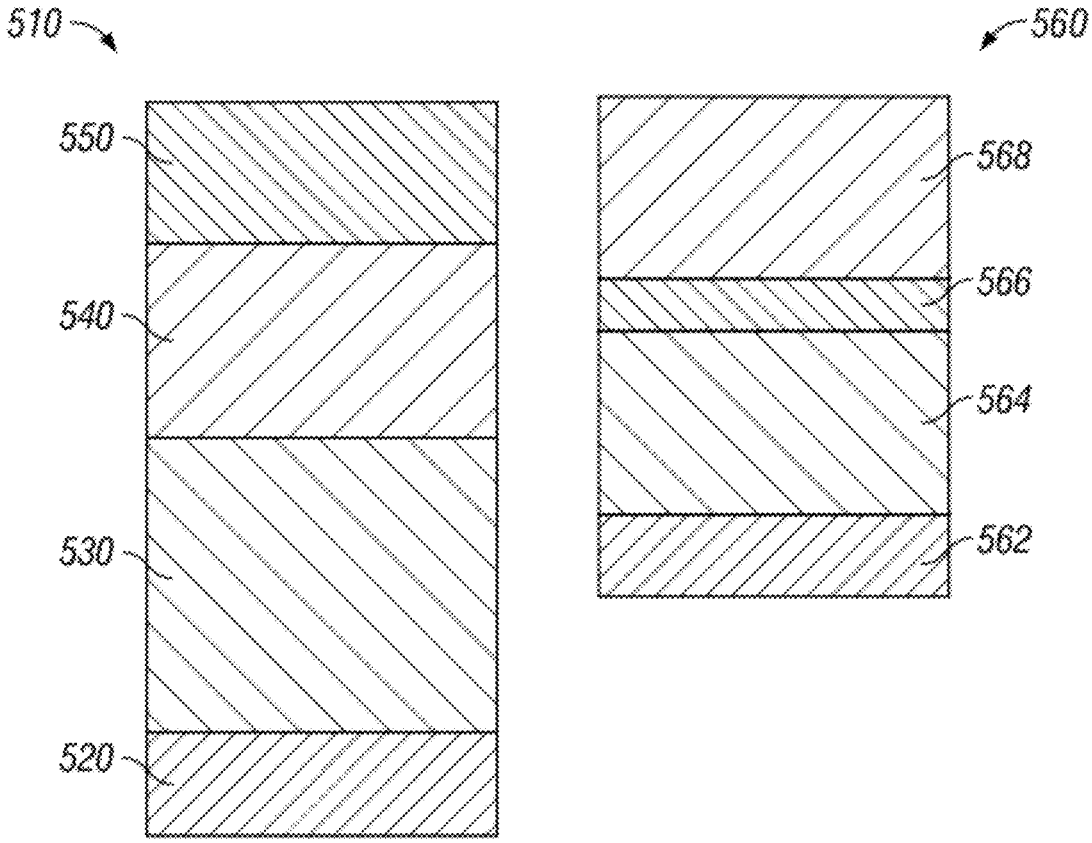
FIG. 5 shows another one of many embodiments of an optimized concrete pavement system utilizing certain aspects of the present invention.
Figure 6A:
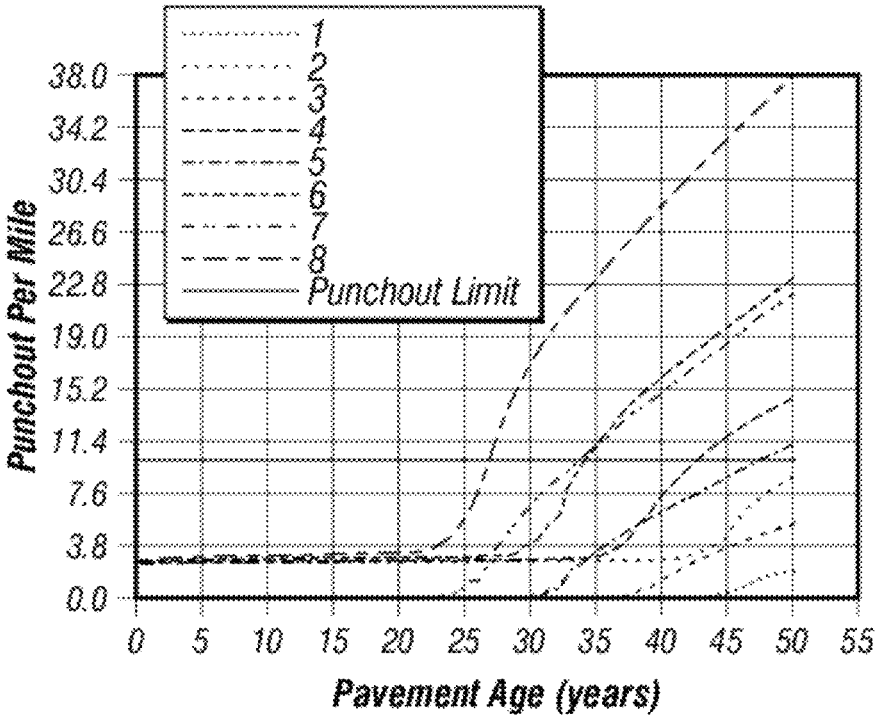
FIG. 6 shows exemplary performance curves of the system of FIG. 5 utilizing certain aspects of the present invention.
Figure 6B:
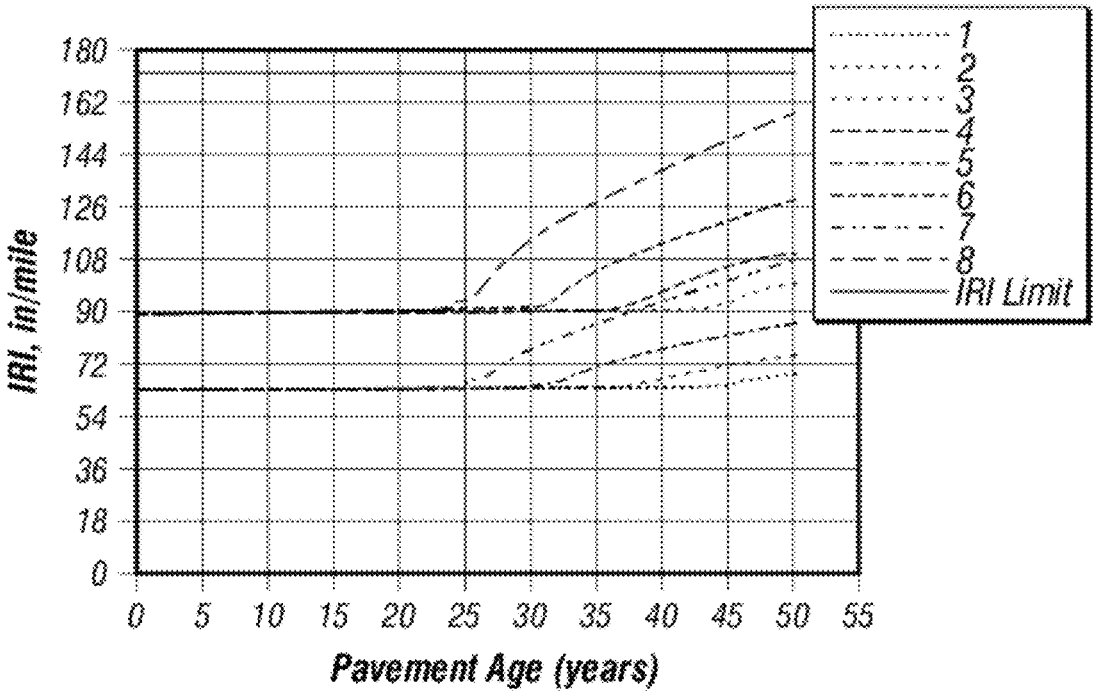
Figure 7:
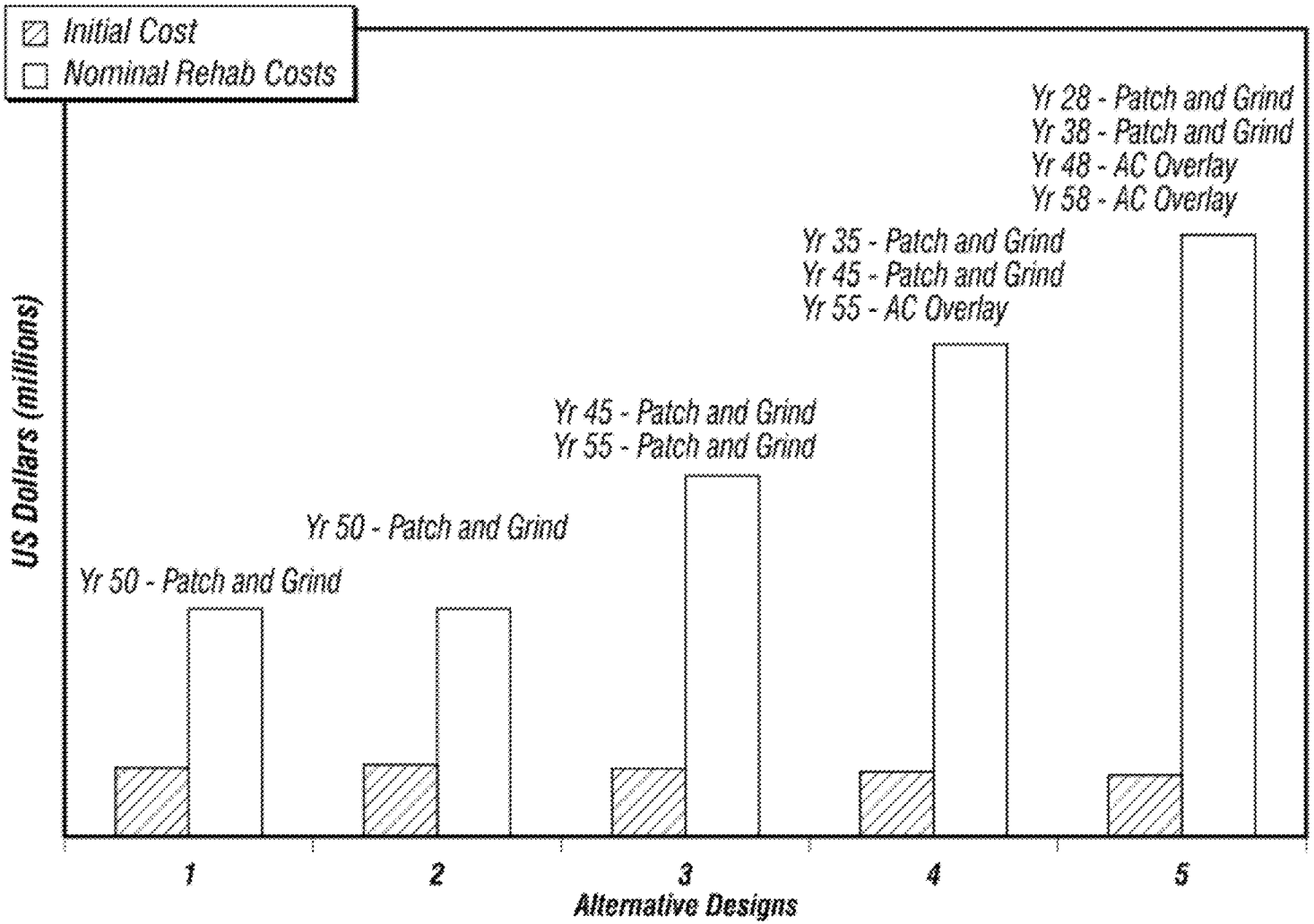
FIG. 7 shows exemplary life cycle pavement costs of the system of FIG. 5 utilizing certain aspects of the present invention.

FIG. 5 shows another one of many embodiments of an optimized concrete pavement system utilizing aspects of the present invention. FIG. 6 shows exemplary performance curves of the system of FIG. 5 utilizing certain aspects of the present invention. FIG. 7 shows exemplary life cycle pavement costs of the system of FIG. 5 utilizing certain aspects of the present invention. FIGS. 5-7 will be described in conjunction with one another to describe one of many embodiments of the present invention. One of ordinary skill in the art will understand that FIGS. 5-7 illustrate a specific example of the present invention, which is presented herein for illustrative purposes only and without any intent of limitation. With reference to FIG. 5, a typical pavement design 510 for a particular application may include one or more layers, having one or more compositions. In the particular embodiment of FIG. 5, for example, subgrade layer 520 may include the soil on which the pavement system may be constructed. Layer 530 may include, for example, 24 inches of Lime-modified subgrade. Layer 540 may include, for example, 10 inches of granular base. As another example, layer 550 may include 9.5 inches of HMAC. While typical design 500 may meet the minimum requirements for the pavement application, typical design 500 may often exceed those requirements such that the costs of the pavement are substantially higher than need be. For example, typical design 500 may be derived from a standard set of guidelines that, for example, may over-engineer many pavement designs resulting in unnecessary expenses.

One having the benefits of this disclosure, however, may optimize the typical design 500 using the teachings of the present disclosure to, for example, develop an optimized design 560. Optimized design 560 may also include one or more layers having one or more compositions. In the particular embodiment of FIG. 5, for example, subgrade layer 562, which may be the same or different from subgrade layer 520, may include the soil on which the pavement system may be constructed. Optimized layer 564 may include, for example, 10 inches of Lime-modified subgrade. Optimized layer 566 may include, for example, 4 inches of asphalt base. As another example, Optimized layer 568 may include 13 inches of CRCP. Optimized design 560 may preferably meet or exceed one or more requirements of the particular application, such as the required estimate performance. Also, optimized design 560 may preferably have, for example, lower initial construction costs than typical pavement design 510.

As shown in FIG. 6, one or more alternative designs (e.g. 4 or 6), including one or more specific factors of each design, may be iterated as described herein to develop optimized design 560. Graph 6A shows, for example, a plurality of exemplary alternative designs iterated with respect to predicted punchout over time. Graph 6B shows, for example, a plurality of exemplary alternative designs iterated with respect to predicted measures of roughness over time. In the exemplary embodiment of FIG. 6, relative roughness is shown to be estimated using the International Roughness Index (IRI), which is only one example of a roughness measurement. One of ordinary skill will understand that graphs 6A and 6B are shown herein for illustrative purposes only, and that any number of considerations required by a particular application may be iterated in accordance with the present invention and that the iterations may be performed any number of times. As shown in FIG. 7, the one or more alternative designs of FIG. 6 may also be iterated in accordance with the present invention with respect to estimated initial costs and/or types of rehabilitation and associated costs. The costs of each alternative design may be compared, for example, to one another and/or to typical design 510 to determine, in whole or in part, optimized design 560 for the particular application. It should be understood that the data shown in FIGS. 5-7 are shown for exemplary purposes only and they are not meant to necessarily correspond to one another or to a particular application.

Figure 8:
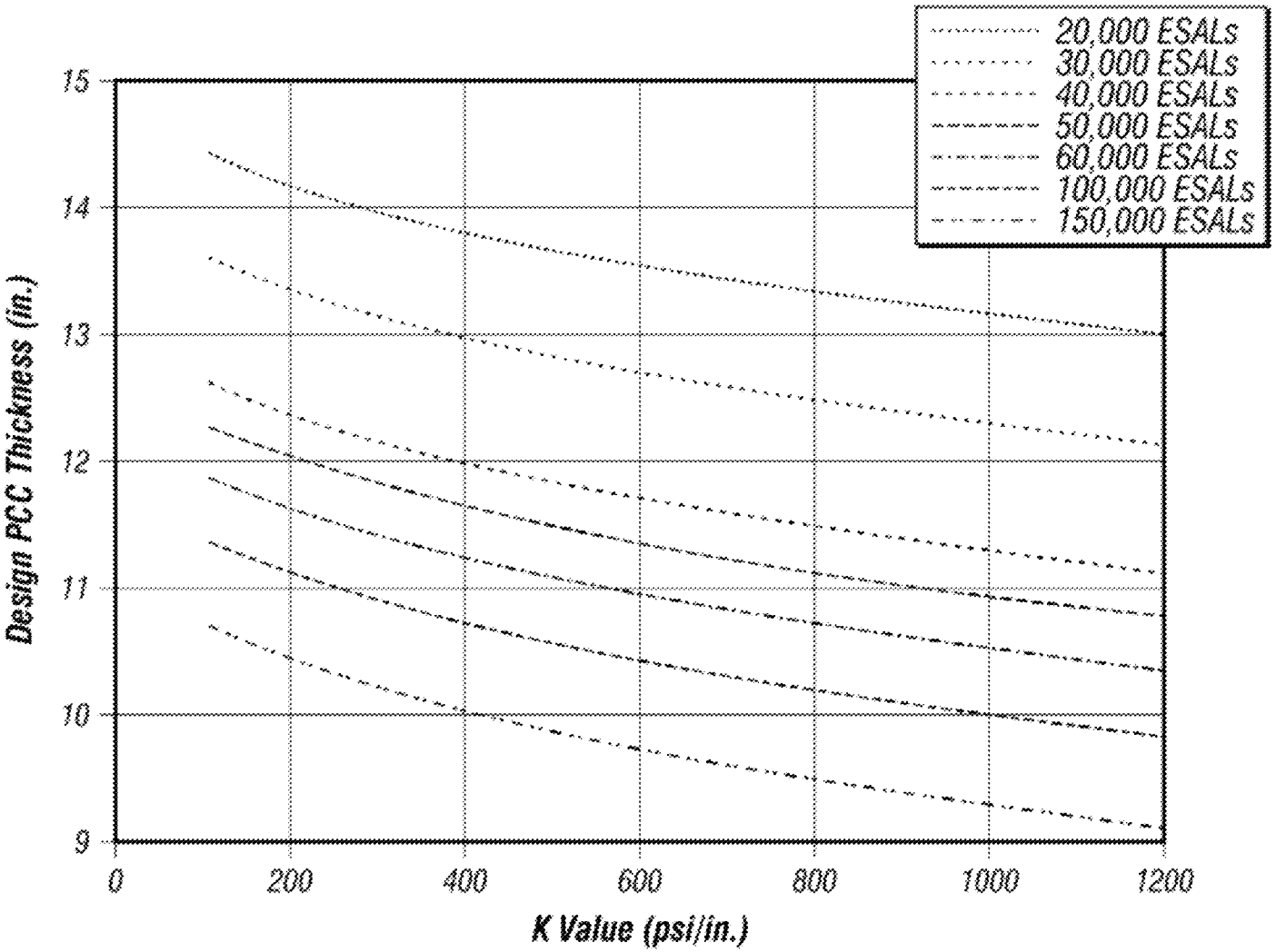
FIG. 8 shows the relationship between thickness of a PCC roadway and the K-value of the substrate according to the present invention.

Turning now to another specific example of how the present invention can be used to design an improved concrete pavement system, or to optimize a concrete pavement design, FIG. 8 represents the relationship between thickness of a PCC roadway and the K-value of the substrate at a specific location for a specific roadway project. It is preferred that the K-value of the substrate be determined empirically, such as by plate bearing tests. It is acceptable for purposes of practicing this invention to estimate the K-value from correlations with soil type, or from soil strength measures, such as the California bearing ratio (CBR), or deflection testing on existing pavements.

AASHTO parameters for this particular project included an Initial Serviceability, $P_o$, of 4.5; Terminal Serviceability, $P_t$, of 2.5; 28-day PCC Flexural Strength, $S'_c$ of 6,800 psi; 28-day PCC Elastic Modulus, E, of 5,000,000 psi; Reliability, R, of 95%; Standard Deviation, $S_o$, of 0.39; Drainage coefficient, $C_d$ of 1; and J-value of 2.60.

As FIG. 8 illustrates, as the K-value of the substrate increases, the roadway thickness required to satisfy the specific design criteria decreases. The present invention makes use of this relationship to design the roadway, a PCC roadway in this example, using the optimum roadway thickness rather than a worst-case thickness or other non-optimized thickness. As the K-value property of the substrate varies by location, the roadway design can be optimized, such as on an installation cost basis by selecting between modifying the K-value of the substrate, reducing, or increasing the thickness of the roadway, or a combination of both. It will be appreciated that frequency with which these design decision points are needed may be controlled by the dimensional spacing between the determined K-values. Typically, a shorter dimensional spacing will allow increased cost optimization.

Other and further embodiments utilizing one or more aspects of the inventions described above can be devised without departing from the spirit of this disclosure. For example, the invention may be implemented in software, firmware, or spreadsheet to name just a few embodiments. Discussion of singular elements can include plural elements and vice-versa.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, Applicants intend to fully protect all such modifications and improvements that come within the scope or range of equivalent of the following claims.

What is claimed is:

1. A computer-based method of optimizing a concrete pavement design for a given section of road, the pavement design comprised of a plurality of specific sections of pavement, comprising:

executing a program on a processor to customize the pavement design, including, for each of the plurality of specific sections of pavement:

estimating a level of traffic for a specific section of pavement;

estimating one or more environmental conditions affecting the section of pavement;

determining characteristic properties of the section subgrade;

developing a concrete system for the section of pavement, including selecting a thickness for the concrete system, based on the level of traffic, the one or more environmental conditions, and the section subgrade;

predicting the performance of the concrete system;

determining the costs of the concrete system, including an initial installation cost for the concrete system and an initial lifetime rehabilitation cost for the concrete system; and optimizing the pavement design based on the plurality of specific sections of pavement, including the system thickness, performance and costs of the concrete system for each specific section of pavement, to create an optimized pavement design for the given section of road, such optimizing including comparing the initial installation cost and the initial lifetime rehabilitation cost for the concrete system for a specific section of pavement with installation costs and lifetime rehabilitation costs for one or more alternative concrete systems for the specific section of pavement and adjusting the concrete system for the specific section of pavement, including the system thickness, to achieve an optimized installation cost and an optimized lifetime rehabilitation cost for the concrete system for the specific section of pavement that satisfies a particular customer application;

wherein the optimized concrete pavement design balances the costs and the performance of the concrete system for each of the plurality of specific sections of pavement such that the concrete system for at least one specific section of pavement has a different system thickness from concrete systems for other specific sections of pavement in the plurality of specific sections of pavement along the given section of road.

2. The method of claim 1, wherein predicting the performance of the concrete system further includes estimating a period of time between initial construction and rehabilitation construction of the system.

3. The method of claim 1, wherein developing a concrete system further includes selecting a stabilizer mix from the group consisting of: 3% Cement Type I/II and 3% Fly Ash Type C; 4% Cement Type I/II and 4% Fly Ash Type C; 6% Cement Type I/II; 6% Lime; and any combination thereof.

4. The method of claim 1, wherein developing a concrete system further includes developing pavement, base, and subgrade layers for the system.

5. The method of claim 1, wherein optimizing the pavement design further includes developing a concrete system based on a fluctuation in the initial or rehabilitation costs.

6. The method of claim 1, wherein developing a concrete system further includes using pavement design guidelines.

7. The method of claim 6, wherein using pavement design guidelines further includes using computer software.

8. The method of claim 7, wherein using computer software further includes using Mechanistic-Empirical Pavement Design Guide software.

9. The method of claim 1, further comprising providing an existing structure and wherein the pavement design is a replacement pavement design to replace the existing structure.

10. The method of claim 9, wherein providing an existing structure includes providing a road.

11. A computer-based method of optimizing a concrete pavement design for a given section of road, the pavement design comprised of a plurality of specific sections of pavement, comprising:

executing a program on a processor to customize the pavement design, including:

estimating a level of traffic for a specific section of pavement;

estimating one or more environmental conditions affecting the section of pavement;

determining characteristic properties of the section subgrade;

developing a first concrete system for the section of pavement based on the level of traffic, the one or more environmental conditions, and the section subgrade, including selecting a thickness for the first concrete system;

predicting the performance of the first concrete system;

determining the costs of the first concrete system, including an initial installation cost for the first concrete system and an initial lifetime rehabilitation cost for the first concrete system;

developing a second concrete system having a stabilizer mix for the section of pavement based on the level of traffic, the one or more environmental conditions, and the section subgrade including selecting a second thickness for the second concrete system;

predicting the performance of the second concrete system;

determining the costs of the second concrete system, including an initial installation cost for the second concrete system and an initial lifetime rehabilitation cost for the second concrete system; and optimizing the pavement design based on the plurality of specific sections of pavement, including calculating the first and second thicknesses, and the performance, and costs of first and second concrete systems for each specific section of pavement to create an optimized pavement design for the given section of road, such optimizing including comparing the initial installation cost and the initial lifetime rehabilitation cost for the first concrete system with the initial installation cost and the initial lifetime rehabilitation cost for the second concrete system for each of the plurality of specific sections of pavement, and developing an optimized concrete system for each specific section of pavement based on the comparison, including an optimized system thickness thereof, that achieves an optimized installation cost and an optimized lifetime rehabilitation cost for a particular customer application;

wherein the optimized concrete pavement design balances the costs and the performance of the concrete system for each of the plurality of specific sections of pavement such that the optimized concrete system for the specific section of pavement has a different system thickness from concrete systems for other specific sections of pavement along the given section of road.

12. An optimized pavement system having predetermined design parameters for a specific section of pavement, the specific section of pavement being one of a plurality of specific sections of pavement along a given section of road, each of the plurality of specific sections of pavement having a corresponding optimized pavement system, the optimized pavement system for the specific section of pavement comprising:

a subgrade layer having a stabilizer mixed therein;

a base layer disposed above the subgrade layer; and a pavement layer disposed above the base layer;

wherein each layer has a thickness according to one or more of the predetermined design parameters such that an initial installation cost and an initial lifetime rehabilitation cost for the optimized pavement system of the specific section of pavement are optimized relative to initial installation costs and initial lifetime rehabilitation costs for one or more alternative pavement systems while satisfying a particular customer application; and wherein the optimized initial installation cost and initial lifetime rehabilitation cost for the optimized pavement system of the specific section of pavement and the performance of the optimized pavement system of the specific section of pavement are balanced such that the optimized pavement system of the specific section of pavement has a different pavement thickness from other pavement systems of other specific section of pavements along the given section of road.

13. The pavement system of claim 12, wherein at least one layer has a thickness proportional to a vertical load requirements of the system.

14. The pavement system of claim 12, further comprising a stabilizer mixed in the base or pavement layer.

15. The pavement system of claim 12, wherein the stabilizer is selected from the group consisting of: 3% Cement Type I/II and 3% Fly Ash Type C; 4% Cement Type I/II and 4% Fly Ash Type C; 6% Cement Type I/II; 6% Lime; and any combination thereof.

16. The pavement system of claim 12, wherein the thickness of at least one layer is optimized by developing a plurality of concrete systems, estimating the cost and performance of each system, and choosing the thickness based on the cost and performance.

17. The pavement system of claim 12, wherein one or more of the layers is optimized based on a plurality of pavement designs.

18. The pavement system of claim 12, wherein an initial construction of the optimized system costs less than a system constructed according to standard pavement guidelines adopted by a state of the United States in which the optimized pavement is constructed.

* * * * *